United States Patent [19]

Ishikawa et al.

[11] Patent Number: 4,510,915

[45] Date of Patent: Apr. 16, 1985

[54] PLASMA IGNITION SYSTEM FOR AN INTERNAL COMBUSTION ENGINE

[75] Inventors: Yasuki Ishikawa; Hiroshi Endo, both of Yokosuka; Masazumi Sone, Tokyo; Iwao Imai, Yokosuka, all of Japan

[73] Assignee: Nissan Motor Company, Limited, Japan

[21] Appl. No.: 428,229

[22] Filed: Sep. 29, 1982

[30] Foreign Application Priority Data

Oct. 5, 1981 [JP] Japan ..... 56-157398

[51] Int. Cl.[3] ..... F02P 3/08

[52] U.S. Cl. ..... 123/620; 123/143 B; 123/643

[58] Field of Search ..... 123/620, 598, 605, 633, 123/143 B, 640, 643, 596

[56] References Cited

U.S. PATENT DOCUMENTS

| | | | |
|---|---|---|---|
| 3,939,814 | 2/1976 | Bergstresser | 123/620 |
| 4,029,072 | 6/1977 | Goto et al. | 123/655 X |
| 4,366,801 | 1/1983 | Endo et al. | 123/643 X |
| 4,369,756 | 1/1983 | Ezoe | 123/640 X |
| 4,398,526 | 8/1983 | Hamai et al. | 123/606 |
| 4,418,660 | 12/1983 | Endo et al. | 123/143 B |
| 4,441,479 | 4/1984 | Endo et al. | 123/605 |

FOREIGN PATENT DOCUMENTS

| | | |
|---|---|---|
| 2152253 | 4/1972 | Fed. Rep. of Germany . |
| 2338556 | 2/1975 | Fed. Rep. of Germany . |

*Primary Examiner*—Tony M. Argenbright

*Attorney, Agent, or Firm*—Lowe, King, Price & Becker

[57] ABSTRACT

An N cylinder internal combustion engine plasma ignition system comprises a DC-DC converter for boosting low DC voltage to high DC voltage. Each of N ignition energy charging circuits includes a first capacitor connected between the DC-DC converter and ground via first and second diodes. The capacitor is charged by the DC-DC converter. Each of N reverse blocked thyristors connected to a junction of the first diode and first capacitor selectively grounds an electrode of the corresponding first capacitor to discharge ignition energy stored in the first capacitor. For each cylinder a transformer connected between the first capacitor and a spark plug boosts and feeds the discharged energy to the plug. One end of the transformer primary winding is grounded via a second capacitor to generate a damped oscillation when the corresponding thyristor grounds the first capacitor. An ignition trigger signal generator sequentially triggers the corresponding thyristor in a predetermined ignition order whenever the engine revolves through a predetermined angle and supplies a pulse to the DC-DC converter in synchronization with the ignition trigger signal. Derivation of the high DC voltage is halted for a period of time according to the pulsewidth. Each of N core-less inductors connected in series with the secondary winding of a transformer restricts an abrupt large current flow from the corresponding spark plug, to extend the discharge duration of each spark plug and ignite the air-fuel fixture stably without misfire.

7 Claims, 5 Drawing Figures

PLASMA IGNITION SYSTEM FOR AN INTERNAL COMBUSTION ENGINE

BACKGROUND OF THE INVENTION

Field of the Invention

The present invention relates to a plasma ignition system for a multi-cylinder internal combustion engine having a plurality of plasma spark plugs each installed within a corresponding engine cylinder, wherein a plurality of core-less inductors (air-core coils) are provided in series with respective secondary windings of voltage boosting transformers.

SUMMARY OF THE INVENTION

It is an object of the present invention to provide a plasma ignition system for a multi-cylinder internal combustion engine, comprising: (a) a low DC voltage supply such as a battery; (b) a DC-DC converter which boosts a low DC voltage from the low DC voltage supply into a high DC voltage; (c) a plurality of charging means which charged by the high DC voltage supplied from the DC-DC converter; (d) a plurality of switching elements each of which is turned on to discharge capacitive energy stored in the corresponding charging means at a predetermined ignition timing; (e) a plurality of voltage boosting transformers each of which boosts the discharged voltage from the corresponding charging means through the corresponding switching elements; (f) a plurality of plasm spark plugs each provided in a corresponding engine cylinder and sparked by high voltage at a secondary winding of the corresponding transformer; and (g) a plurality of core-less inductors such that magnetic saturation occurs at a relatively large magnetic field intensity, each connected in series with the secondary winding of the corresponding transformer, whereby a discharge duration can be extended so as to enable a stable ignition of air-fuel mixture.

BRIEF DECRIPTION OF THE DRAWINGS

The features and advantages of the present invention will be appreciated from the foregoing description in conjunction with the accompanied drawings in which like reference numerals designate corresponding elements and in which.

Figure 1:
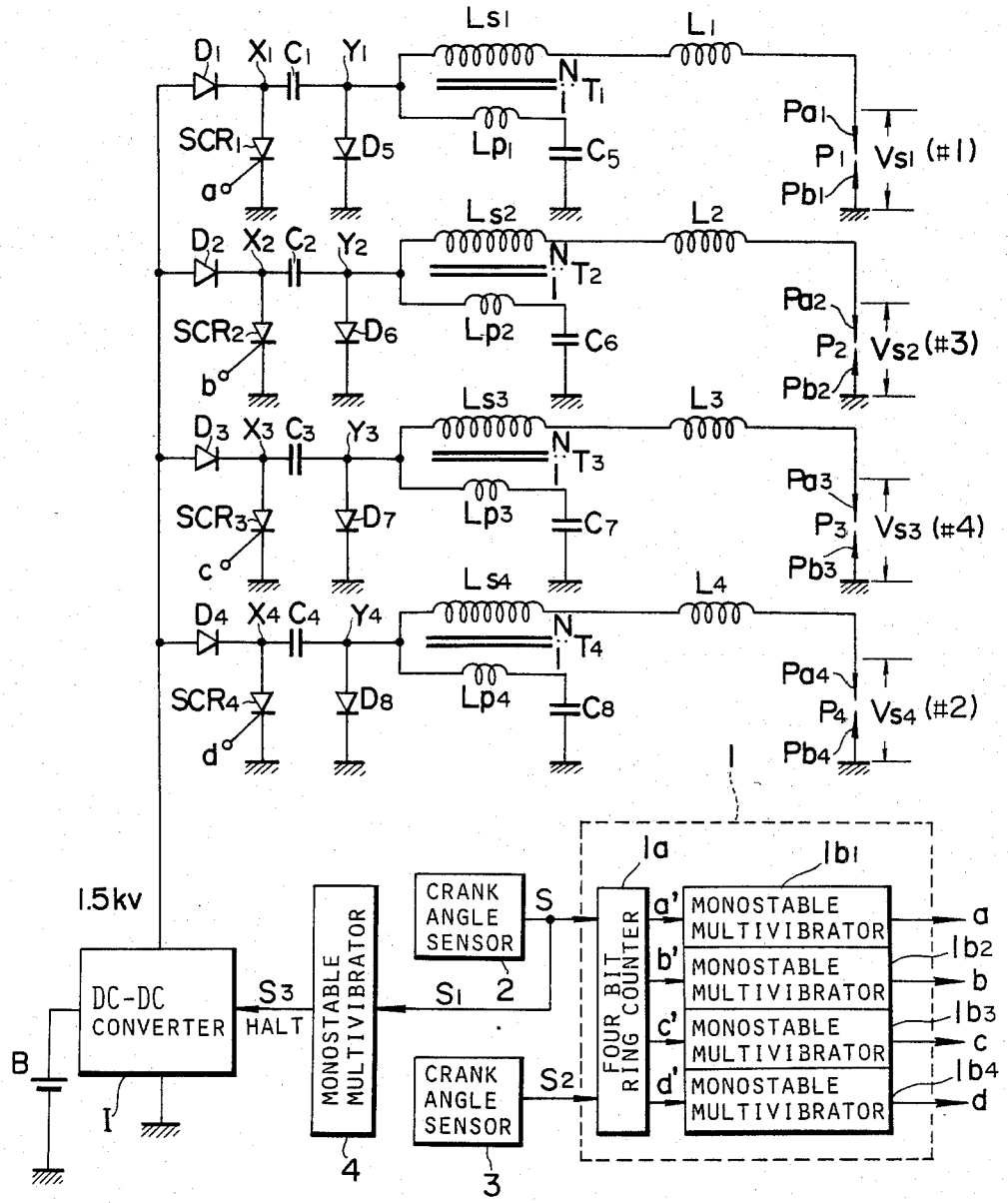
FIG. 1 is a circuit diagram of a first preferred embodiment of a plasma ignition system according to the present invention, as applied to a four-cylinder engine.
Figure 3:
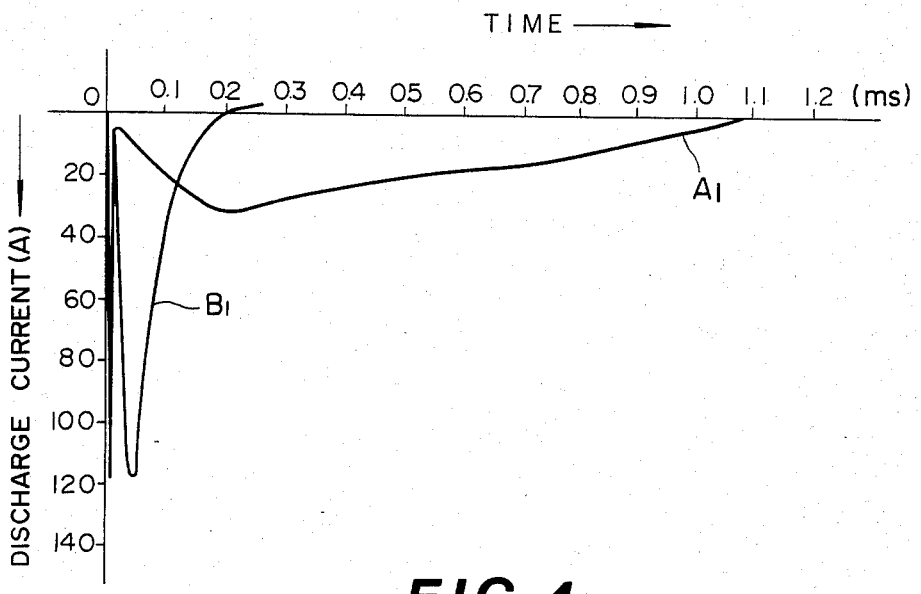
Figure 4:
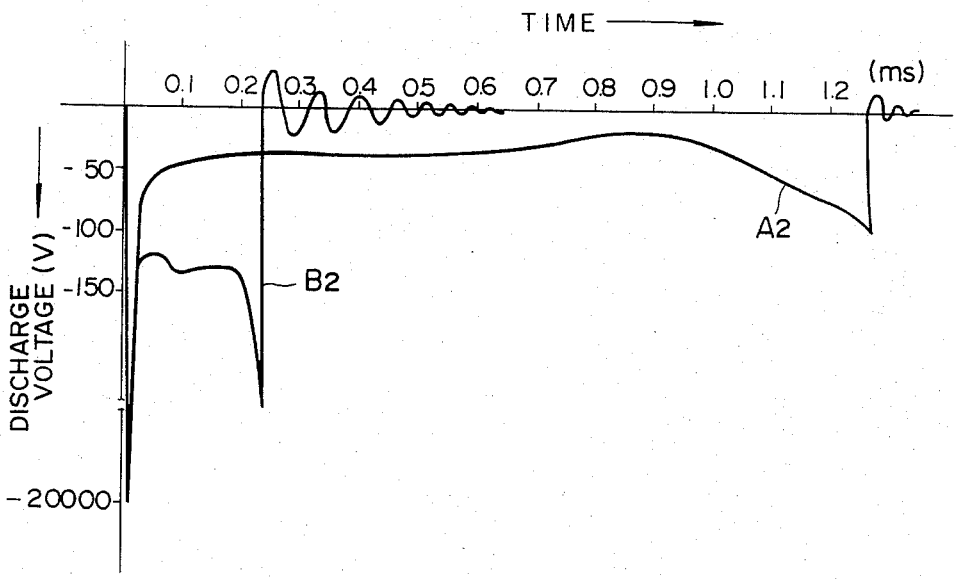
Figure 5:
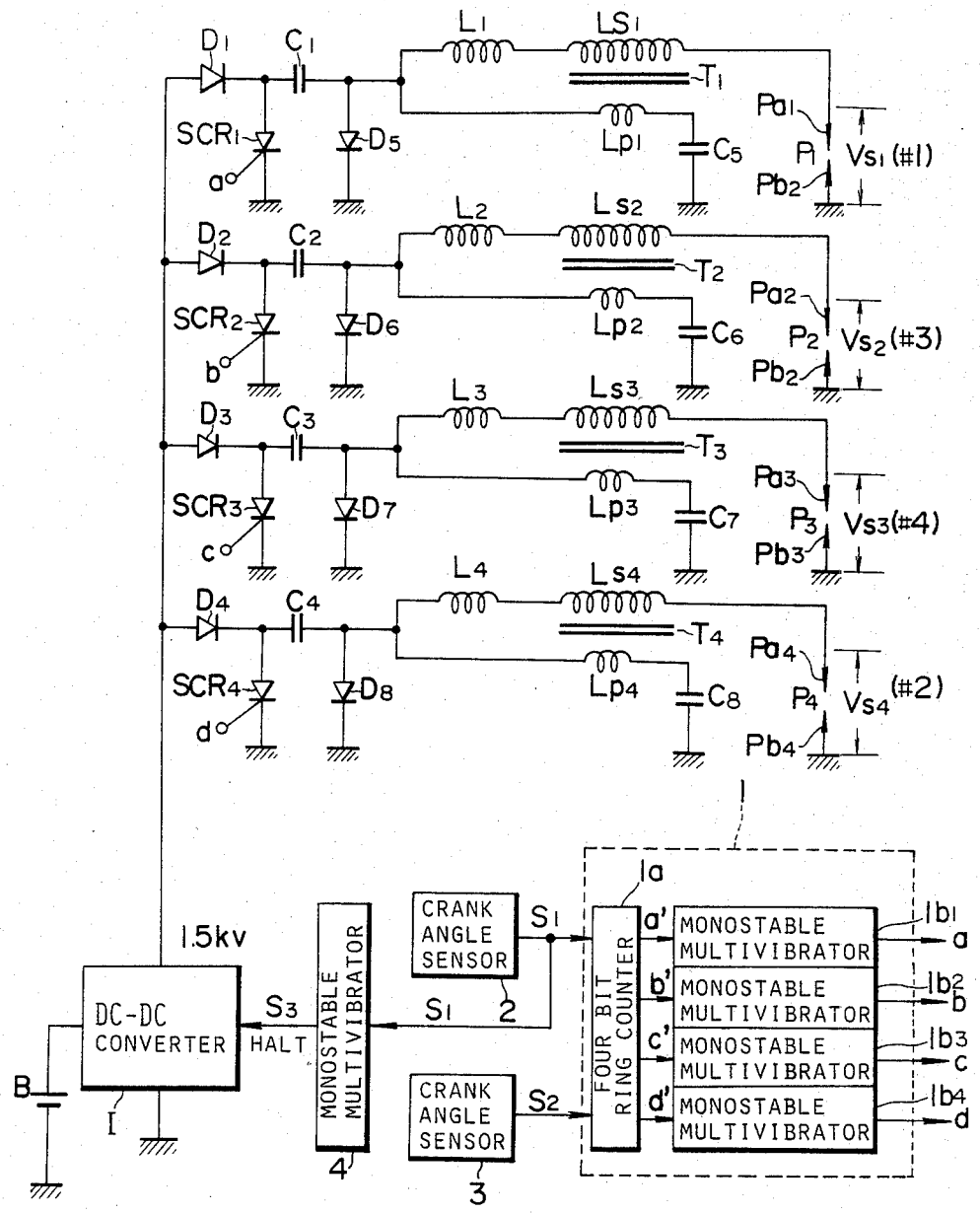

FIG. 3 is a discharge voltage pattern of the plasma ignition system shown in FIG. 1 for comparison with another plasma ignition system wherein the core-less inductors are not provided; and FIG. 4 is a discharge current pattern of the plasma ignition system shown in FIG. 1 for comparison with the prior art plasma ignition system wherein the core-less inductors are not provided; and FIG. 5 is a circuit diagram of a second preferred embodiment of a plasma ignition system according to the present invention.

DETAILED DESCRIPTION OF THE REFERRED EMBODIMENTS

Reference will be made hereinafter to the drawings in order to facilitate understanding of the present invention.

In FIG. 1, a circuit diagram of a first preferred embodiment according to the present invention, battery B supplies a low DC voltage (e.g., plus 12 volts), to DC-DC converter I which boosts the low DC voltage into a high DC voltage (e.g., 1.5 kilovolts). The DC-DC converter I, e.g., inverts the low DC voltage into a corresponding AC voltage by an oscillation action and boosts the AC voltage into a high AC voltage by means of a built-in transformer and rectifies the high AC voltage into the high DC voltage. The boosted high DC voltage is applied across a plurality of first capacitors $C_1$ through $C_4$ via corresponding first diodes $D_1$ through $D_4$ when respective thyristors $SCR_1$ through $SCR_4$ as switching elements are turned off.

A first end $X_1$ through $X_4$ of each first capacitor $C_1$ through $C_4$ is connected to an anode of the corresponding first diode $D_1$ through $D_4$ and to a cathode of the corresponding thyristor $SCR_1$ through $SCR_4$. An anode of each thyristor $SCR_1$ through $SCR_4$ is grounded.

A second end $Y_1$ through $Y_4$ of each first capacitor $C_1$ through $C_4$ is connected to a cathode of each second diode $D_5$ through $D_8$. An anode of each second diode $D_5$ through $D_8$ is grounded. Each second end $Y_1$ through $Y_4$ of the corresponding first capacitor $C_1$ through $C_4$ is connected to a common end of a corresponding voltage boosting transformer $T_1$ through $T_4$ having a core. A second diode $C_5$ through $C_8$ is connected between the other end of each primary winding $Lp_1$ through $Lp_4$ of the transformer $T_1$ through $T_4$ and ground. The winding ratio between the primary and secondary windings $L_p$ and $L_s$ of each transformer $T_1$ through $T_4$ is I:N. The other end of each secondary winding $Ls_1$ through $Ls_4$ is connected to a central electrode $Pa_1$ through $Pa_4$ of a corresponding plasma spark plug $P_1$ through $P_4$. Side electrodes $Pb_1$ through $Pb_4$ of the respective plasma spark plugs $P_1$ through $P_4$ are grounded. The first plasma spark plug $P_1$ is installed in a first engine cylinder (#1), the second plasma spark plug $P_2$ to a third cylinder (#3), the third plasma spark plug $P_3$ to a fourth cylinder (#4), and the fourth plasma spark plug $P_4$ to a second cylinder (#2) in accordance with a predetermined ignition order (i.e., #1→#3→#4→#2).

In this preferred embodiment, each core-less inductor $L_1$ through $L_4$ (also called air-core coil) is connected between the other end of the corresponding secondary winding $Ls_1$ through $Ls_4$ and the central electrode $Pa_1$ through $Pa_4$ of the corresponding plasma spark plug $P_1$ through $P_4$. The function of each core-less inductor $L_1$ through $L_4$ is described later.

Furthermore, A gate of each thyristor $SCR_1$ through $SCR_4$ is connected to an output terminal of a corresponding monostable multivibrator $\mathbf{1}b_1$ through $\mathbf{1}b_4$ of an ignition signal control circuit 1. The ignition signal control circuit 1 comprises a four-bit ring counter 1*a* for circularly distributing a first pulse signal $S_1$ having a period corresponding to a predetermined revolutional angle of an engine crankshaft (i.e., 180° ). Signal $S_1$ is coupled in parallel to a clock terminal of counter 1*a* from a first crank angle sensor 2, and to the four monostable multivibrators $\mathbf{1}b_1$ through $\mathbf{1}b_4$. The bit number of the ring counter 1*a* and the number of monostable multivibrators $1b_1$ through $1b_4$ depend respectively on the number of engine cylinders. The ring counter 1*a* also receives a reset signal $S_2$ at a reset terminal thereof from a second crank angle sensor 3. These first and second crank angle sensors 2 and 3 are attached to the engine crankshaft (not shown) for generating outputting the first pulse and reset signals whenever the engine revolves through the respective predetermined angles (the reset signal $S_2$ has a period corresponding to two revolutions of the engine crankshaft). The first pulse signal $S_1$ is also sent into another monostable multivibrator 4. The monostable multivibrator 4 generates a second pulse signal $S_3$ having a predetemined pulsewidth (e.g., 1 millisecond) whenever the first pulse signal $S_1$ is received thereby. The second pulse signal $S_3$ is coupled to a halt terminal of the DC-DC converter I for temporarily halting the oscillation of the DC-DC converter I. Therefore, the DC-DC converter I halts coupling of the high DC voltage to the first capacitors $C_1$ through $C_4$ so that the corresponding thyristor $SCR_1$ through $SCR_4$ through which the high DC voltage within the first capacitor $C_1$ through $C_4$ is discharged is naturally turned off.

The operation of the plasma ignition system shown in FIG. 1 is described hereinafter with reference to a signal waveform timing chart shown in FIG. 2.

The DC-DC converter I supplies the high DC voltage (1.5 kilovolts) to the first capacitors $C_1$ through $C_4$ through the respective first diodes $D_1$ through $D_4$, with the respective second ends $Y_1$ through $Y_4$ grounded via the respective second diodes $D_5$ through $D_8$, so that a relatively large amount to ignition energy ($\frac{1}{2}CV^2=1.1$ Joules) is stored in each of the first capacitors $C_1$ through $C_4$ (capacitance value of each first capacitor $C_1$ through $C_4$ is 1 microfarad). On the other hand, the four-bit ring counter 1*a* of the ignition signal control circuit 1 is reset in response to the trailing edge of the reset signal $S_2$ received from the second crank angle sensor 3. Counter 1*a* sequentially derives four pulse signals a', b', c', and d' as shown in FIG. 2 in response to the leading edge of the serial first pulse signals $S_1$ derived from the first crank angle sensor 1. The monostable multivibrator $1b_1$ through $1b_4$ sequentially derive trigger pulse signals a, b, c, and d each having a predetermined pulsewidth (0.5 milliseconds) in response to the corresponding output signal a', b', c', and d' from the ring counter 1*a*.

When each thyristor $SCR_1$ through $SCR_4$ receives the corresponding trigger pulse signal a through d at the gate thereof, the thyristors $SCR_1$ through $SCR_4$ turn on sequentially according to the predetermined ignition order. Consequently, the first ends $X_1$ through $X_4$ of the respective first capacitors $C_1$ through $C_4$ are sequentially grounded via the respective thyristors $SCR_1$ through $SCR_4$.

At this time, the potential of the first end $X_1$ through $X_4$ of each first capacitor $C_1$ through $C_4$ changes from the plus high DC voltage (+1.5 kilovolts) to zero abruptly so that the potential of the second end $Y_1$ through $Y_4$ thereof changes from zero to the minus high DC voltage (−1.5 kilovolts).

Therefore, the minus high DC voltage is applied to the corresponding transformer $T_1$ through $T_4$ so that an electric current flows from the corresponding first capacitor $C_1$ through $C_4$ into the corresponding second capacitor $C_5$ through $C_8$ through the corresponding thyristor across the corresponding thyristor $SCR_1$ through $SCR_4$ and the corresponding primary winding $Lp_1$ through $Lp_4$. There is thus derived at secondary windings $Ls_1$ through $Ls_4$ a together with the primary winding $Lp_1$ through $Lp_4$ and a boosted high peak voltage (FIG. 2) having a value determined by the winding ratios the transformers $T_1$ through $T_4$. Consequently, a spark discharge occurs at a discharge gap between the central and side electrodes $Pa_1$ and $Pb_1$, $Pa_2$ and $Pb_2$, $Pa_3$ and $Pb_3$, and $Pa_4$ and $Pb_4$ of the corresponding plasma spark plugs $P_1$ through $P_4$.

Since the discharge gap electrical resistance of the spark plugs $P_1$ through $P_4$ drops below several ohms once the spark discharge described above occurs, a high energy remaining in a corresponding second capacitor (about 1 Joule) is gradually fed into the discharge gap of the corresponding spark plug $P_1$ through $P_4$ via the secondary winding $Ls_1$ through $Ls_4$ of the transformer $T_1$ through $T_4$ and the core-less inductor $L_1$ through $L_4$. The capacitance value of each second capacitor $C_5$ through $C_8$ is uniformly lower than that of each first capacitor $C_1$ through $C_4$.

It should be noted that although the secondary winding $Ls_1$ through $Ls_4$ of the respective transformers $T_1$ through $T_4$ have a large inductance L against a range of a small current flow, a large current flows through the secondary windings $Ls_1$ through $Ls_4$ of each transformer $T_1$ through $T_4$ since the resistance of the discharge gap in the corresponding spark plug $P_1$ through $P_4$ drops extremely to below several ohms. Thereby, the magnetic cores of transformers $T_1$ through $T_4$ are immediately saturated because of a large magnetic field intensity H generated by the large current flow. Consequently, the normal current flow restricting action of a magnetic core inductor does not occur. On the other hand, core-less inductors $L_1$ through $L_4$ L hardly saturate in response to such a large current flow so as to provide sufficient current restriction action. Inductors $L_1$ through $L_4$ have linear inductances that are not susceptible to saturation in response to the current flowing through them mainly because they do not have such a magnetic core.

In addition, the current flow restricting action of the core-less inductors $L_1$ through $L_4$ causes (1) the energy stored in the respective first capacitors $C_1$ through $C_4$ to be discharged for a relatively long period of time and (2) a current peak value to be suppressed.

Such a discharge current pattern $A_1$ is shown in FIG. 3. In FIG. 3, another pattern $B_1$ is illustrated for the case of another ignition system wherein core-less inductors $L_1$ through $L_4$ are not used.

When such a high-energy charge is fed into each plasma spark plug $P_1$ through $P_4$, plasma gap is generated between both electrodes Pa and Pb of each spark plug $P_1$ through $P_4$ so that an air-fuel mixture supplied to the corresponding cylinder is ignited without misfire because a plasma gas is generated for the relatively long period of time.

There are two additional effects to consider, viz: (1) electrodes of the plasma spark plugs $P_1$ through $P_4$ are instantaneously heated because of a reduced peak discharge power so that the metal constituting each electrode of the spark plugs $P_1$ through $P_4$ hardly corrodes to prolong the service life of the spark plugs $P_1$ through $P_4$ and (2) electromagnetic wave noise is greatly reduced because there is such a slow change in the discharge current with respect to time as shown by pattern $A_1$ of FIG. 3.

Figure 2:
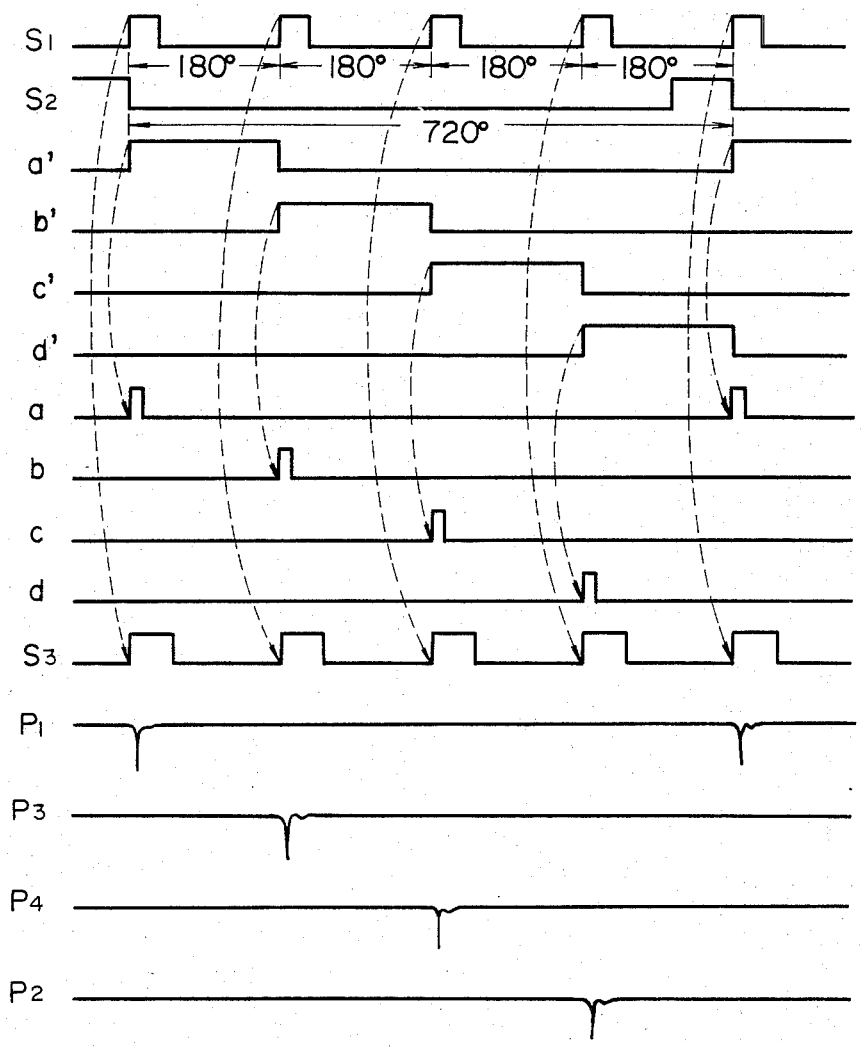
FIG. 2 is a timing chart of the output signal waveforms of an internal circuit block shown in FIG. 1.

A discharge pattern of the voltage applied across the discharge gap of each spark plug $P_1$ through $P_4$ is shown generally in FIG. 2 and, in detail by waveform $A_2$ of FIG. 4. In FIG. 4, another voltage discharge pattern $B_2$ is illustrated in the case of the other plasma ignition system wherein such core-less inductors $L_1$ through $L_4$ are not provided.

In FIG. 5 is shown a second preferred embodiment according to the present invention, wherein such core-less inductors $L_1$ through $L_4$ also shown in FIG. 1 are provided respectively between the corresponding common end of the transformer $T_1$ through $T_4$ and one end of the secondary windings $Ls_1$ through $Ls_4$.

The other connections of each circuit element are the same as shown in FIG. 1. Therefore, the details of each circuit construction and operation are omitted.

In such connections as shown in FIG. 5, there is an additional effect that since an extremely high discharge voltage is not directly applied to such core-less inductors $L_1$ through $L_4$, an insulation measure of such core-less inductors can easily be taken.

As described hereinbefore, the present invention relates to a plasma ignition system for an internal combustion engine, wherein each inductor of a core-less coil is connected in series with a secondary winding of a corresponding voltage boosting transformer so as to suppress a change in large discharge current flow through a corresponding plasma spark plug by means of a core-less inductor almost incapable of magnetic saturation.

The plasma ignition system according to the present invention has the following advantageous effects: (1) Since the discharge duration is extended, the ignition of an air-fuel mixture can be carried out even when a combustion environment is not favorable; (2) Since a peak value of the discharge current is reduced, wear-out of each electrode of the spark plugs is reduced; (3) Since a load on each switching element (thyristor $SCR_1$ through $SCR_4$) is reduced, a switching element of relatively small capacity can be used; and (4) Since the change in the discharge current with respect to time is relatively slow, the generation of electromagnetic wave noise can accordingly be suppressed.

In the first preferred embodiment shown in FIG. 1, each of the secondary and primary windings can easily be insulated. On the other hand, in the second preferred embodiment shown in FIG. 5 each core-less inductor can easily be insulated with respect to ground since an extremely high voltage is not directly applied thereto.

It will be understood by those skilled in the art that various changes and modifications may be made without departing from the spirit and scope of the present invention, which is to be defined by the appended claims.

What is claimed is:

1. A plasma ignition system for an internal combustion engine, comprising:

(a) a plurality of plasma spark plugs each having a discharge gap between a central electrode and a grounded side electrode, said discharge gap being located in a corresponding engine cylinder;

(b) a DC-DC converter for boosting a low DC voltage into a high DC voltage;

(c) a plurality of ignition energy charging means, each having a first diode connected to said DC-DC converter, a first capacitor having a first terminal connected to said first diode and a second terminal connected to ground via a second diode, the first capacitor being charged by the high DC voltage from said DC-DC converter via a series path including said first and second diodes;

(d) a plurality of reverse blocked triode thyristors, each having an anode connected to the first terminal of said first capacitor and a grounded cathode, each thryistor being selectively turned on so as to discharge the energy stored in the said first capacitor therethrough;

(e) a plurality of voltage boosting transformers, each having a primary winding and secondary winding and a magnetic core that couples the primary and secondary windings to each other, the magnetic core having a tendency to saturate in response to current resulting from discharges of the first capacitor, first and second ends of said primary winding of each transformer being respctively connected in series with the second terminal of said first capacitor and to ground via a second capacitor having a capacitance value smaller than said first capacitor whereby a damped oscillation is generated in the second capacitor when the capacitive energy is discharged from said first capacitor through said thyristor, first and second ends of said secondary winding being respectively connected in series with the second terminal of said first capacitor and to the central electrode of the corresponding plasma spark plug, whereby the voltage applied to said corresponding primary winding is boosted and the boosted voltage is applied to the corresponding spark plug;

(f) an ignition trigger signal generator for (1) circularly generating and coupling a trigger signal to a gate of said corresponding thyristor according to a predetermined ignition order of the engine cylinders in response to the engine revolving through a predetermined angle and (2) generating and coupling another pulse signal having a predetermined pulsewidth to said DC-DC converter in synchronization with the ignition trigger signal for halting derivation of the high DC voltage for a period of time determined by said pulsewidth of the pulse signal; and (g) a plurality of core-less inductors each connected in series with the secondary winding of said corresponding voltage boosting transformer and the electrodes for restricting an abrupt large discharge current flow through the corresponding plasma spark plug discharge gap so as to extend the ignition energy flow through said gap by the corresponding plasma ignition plug.

2. A plasma ignition system as set forth in claim 1, wherein each of said core-less inductors is connected between the second end of the secondary winding of said corresponding voltage boosting transformer and the central electrode of said corresponding plasma spark plug.

3. A plasma ignition system as set forth in claim 1, wherein each of said core-less inductors has first and second terminals respectively connected to a common terminal for the first end of said primary winding and for the second terminal of the first capacitor and to the first primary winding and one end of the secondary winding of said corresponding voltage boosting transformer, the other end of the secondary winding being directly connected to the central electrode of said corresponding plasma spark plug.

4. A plasma ignition system for an internal combustion engine, comprising:

(a) a plurality of plasma spark discharge gaps, each gap being located in a corresponding engine cylinder so as to receive an air-fuel mixture;

(b) a plurality of high voltage energy charging capacitors each of which is charged to high voltage energy;

(c) a plurality of switching elements, each responsive to a signal produced according to a predetermined ignition order, for discharging the charged high voltage energy in the corresponding capacitor;

(d) a plurality of voltage boosting transformers each having a primary and secondary winding, one end of each primary winding thereof being connected to a second capacitor so that a damped oscillation is generated thereat when the corresponding high voltage ignition energy charged capacitor is discharged by means of said corresponding switching element, one end of each secondary winding thereof being connected to said corresponding discharge gap, the transformer boosting and applying the damped oscillation voltage generated at the primary winding thereof and coupling a subsequent high voltage ignition energy charged in said corresponding high voltage energy charging capacitor to said corresponding discharge gap, the primary and secondary windings being coupled to each other by a magnetic core having a tendency to saturate in response to current flowing to the gap in response to discharges of the high voltage energy, whereby there is a tendency for an abrupt large discharge current to flow in the gap; and (e) a plurality of core-less inductors each connected in series with the secondary winding of said corresponding transformer for restricting the tendency for the abrupt large discharge current to flow through said corresponding discharge gap in response to the subsequent high voltage ignition energy charged in said corresponding high voltage energy charging capacitor being discharged to said corresponding discharge gap.

5. An electronic breakerless plasma ignition system responsive to a low voltage DC source, the system being provided for an internal combustion engine having N cylinders, each cylinder including a separate plasma spark discharge gap responsive to an air-fuel mixture, where N is an integer greater than one, the system comprising:

(a) N energy storing capacitors, one of said capacitors being provided for each of the gaps;

(b) means responsive to the low voltage source for charging the capacitors to a high DC voltage, so that each capacitor stores sufficient energy to establish an ignition discharge current through its corresponding gap;

(c) means synchronized with operation of the engine cylinders for separately and sequentially discharging energy stored in each capacitor through its corresponding gap to provide the ignition discharge current through each gap, the means for discharging for each capacitor and each gap including:

(i) means including semiconductor switch means and resonant circuit means for establishing a current having a tendency to oscillate, the semiconductor switch means being cut-off in response to a change in polarity of the current so that the current is cut-off in response to a change in polarity thereof, the establishing means including a transformer having a primary winding connected in series with the energy storing capacitor and the semiconductor switch means, whereby a voltage pulse is derived across the primary winding in response to the ignition discharge current flowing in the gap;

(ii) means for boosting the amplitude of the voltage pulse and for applying the boosted voltage pulse across the gap, the boosting means including a secondary winding of the transformer, the transformer having a magnetic core coupling the primary and secondary windings together, the core having a tendency to saturate in response to the ignition discharge current flowing to the gap, whereby there is a tendency for an abrupt large discharge current to flow in the gap; and (iii) means for attenuating and for extending the duration of the abrupt large discharge current that tends to flow in the gap, said attenuating and extending means including a core-less inductor connected in series with the secondary winding and the gap.

6. The system of claim 5 wherein the core-less inductor is connected between a first terminal of the secondary winding and an ungrounded electrode of a plasma discharge device including the gap, a second terminal of the secondary winding being connected to an electrode of the capacitor.

7. The system of claim 5 wherein the core-less inductor is connected between a first terminal of the secondary winding and an electrode of the capacitor, a second terminal of the secondary winding being connected to an ungrounded electrode of a plasma discharge device including the gap.

* * * * *